United States Patent [19]

Winkler

[11] Patent Number: 5,062,598

[45] Date of Patent: Nov. 5, 1991

[54] DELIVERY SYSTEM FOR UNDER THE COUNTER CURRENCY DISPENSER

[75] Inventor: Theodore Winkler, Levittown, Pa.

[73] Assignee: Brandt, Inc., Bensalem, Pa.

[21] Appl. No.: 635,389

[22] Filed: Dec. 28, 1990

Related U.S. Application Data

[63] Continuation of Ser. No. 371,499, Jun. 26, 1989, abandoned.

[51] Int. Cl.[5] ..... B65H 5/22

[52] U.S. Cl. ..... 271/6; 271/207; 271/259; 221/21

[58] Field of Search ..... 271/6, 7, 207, 213, 271/256, 258, 259, 261, 303, 265, 315; 209/534; 221/21; 194/206, 207

[56] References Cited

U.S. PATENT DOCUMENTS

| | | | |
|---|---|---|---|
| 3,674,258 | 7/1972 | Maier et al. | 271/202 |
| 3,937,453 | 2/1976 | Hickey et al. | 271/259 |
| 4,157,822 | 6/1979 | Miller | 271/265 |
| 4,340,150 | 7/1982 | Guibord et al. | 221/21 |
| 4,423,826 | 1/1984 | Hirata et al. | 221/21 |
| 4,638,993 | 1/1987 | Granzow et al. | 271/315 |
| 4,711,441 | 12/1987 | Taylor | 271/259 |

FOREIGN PATENT DOCUMENTS

| | | | |
|---|---|---|---|
| 0100059 | 6/1983 | Japan | 271/207 |
| 2085849 | 5/1982 | United Kingdom | 271/10 |

*Primary Examiner*—H. Grant Skaggs
*Attorney, Agent, or Firm*—Shenier & O'Connor

[57] ABSTRACT

A currency note dispenser especially adapted for under-the counter use in which a conveyor carries notes removed from the bottom of a supply stack to a delivery tray at an access location above the supply. In response to a malfunction of the dispenser, an energizable element moves the tray to an inoperative position at which notes previously delivered thereto fall to an escrow area in the dispenser cabinet and hold the tray in that position until all notes received by the conveyor have passed to the escrow area. Before moving the tray, the energizable element releases a mechanical lock which prevents movement of the tray to its inoperative position in the absence of energization of the energizable element.

15 Claims, 5 Drawing Sheets

FIG. 5
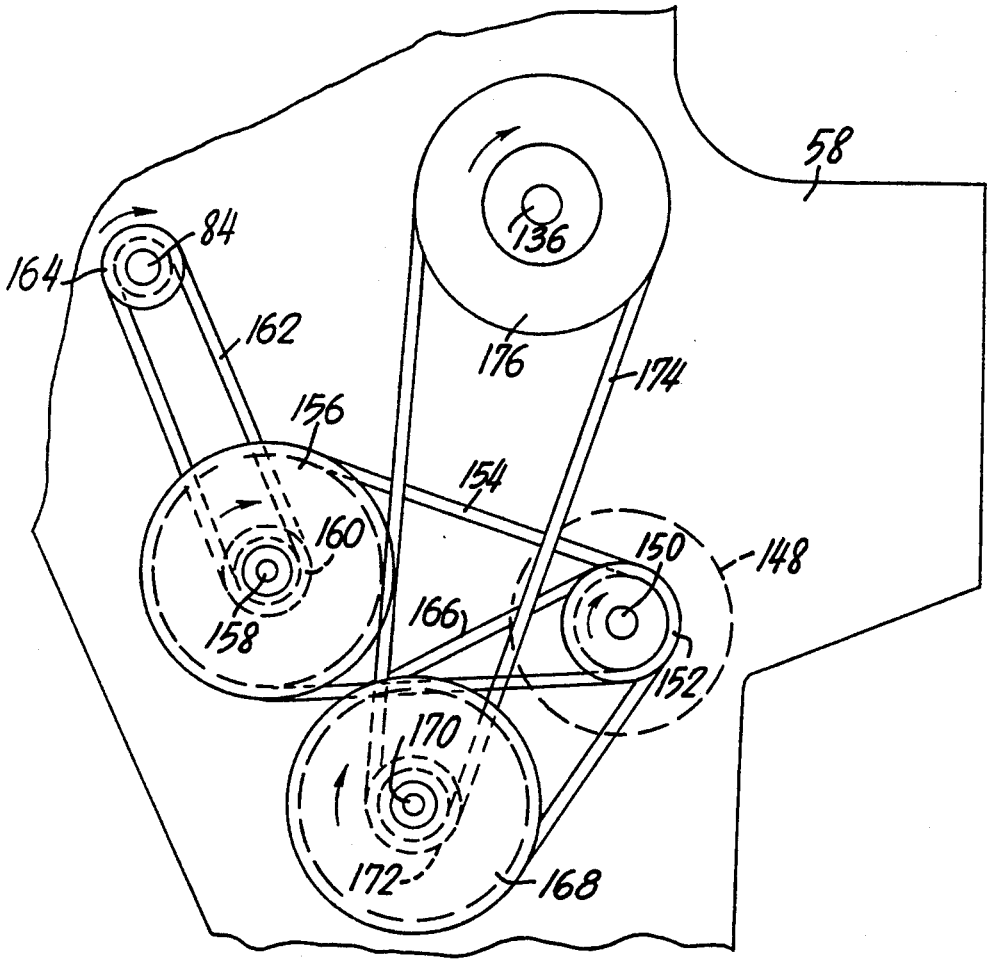
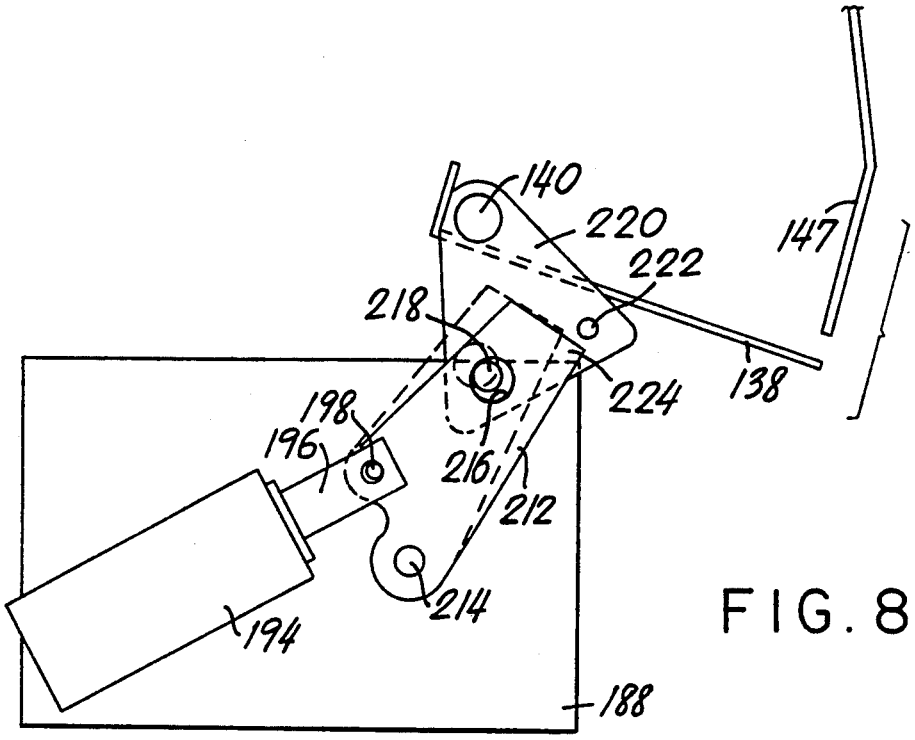
FIG. 8

DELIVERY SYSTEM FOR UNDER THE COUNTER CURRENCY DISPENSER

This is a continuation of copending application Ser. No. 07/371,499 filed on June 26, 1989 now abandoned.

FIELD OF THE INVENTION

The invention is in the field of currency dispensers and, more particularly, currency dispensers of the type which deliver a preselected mix of bills of different denominations to an open tray which is immediately accessible to the operator of the dispenser.

BACKGROUND ART

There are known in the prior art various machines for conveying currency in the form of notes from supplies of notes of various denominations to a delivery location. One type of such machine is an automatic teller which delivers the money to be dispensed to a delivery area behind a normally locked access door. If the amount of money in the delivery area is correct, the door is opened to afford the customer access to the money. One such system is shown in U.S. Pat. No. 4,482,057.

Another type of cash dispenser intended to facilitate the work of bank tellers or cashiers or the like is actuated by the teller to cause the apparatus to deliver the required sum of money to an open tray which is immediately accessible to the operator of the machine. Machines of this type generally are of the counter top type. One such machine is shown in U.S. Pat. No. 4,660,822. The control system for this machine is disclosed in U.S. Pat. No. 4,709,914. In operation of the counter top dispenser shown in these patents, bills are drawn from the bottoms of the respective supply and conveyed along a generally horizontal path to an output stacker which places the bills in the an escrow area within the machine. The delivery tray is held in its inoperative position sufficiently long to ensure that all bills which have been drawn from the supplies pass by the shelf into the escrow area. In this way, the requirement that the teller or other operator remove the bills from the delivery tray following a malfunction is eliminated. In addition, it facilitates accounting for money which had been placed in the dispenser in that all bills which have been withdrawn from the supplies either should have been delivered to the customer or remain in the machine.

In addition to the foregoing, I provide the machine with a mechanical lock which prevents the delivery tray from being moved to its inoperative position to gain access to the escrow area when the machine is idle, for example. While preventing such movement of the tray, the lock is readily disabled upon the occurrence of an error signal to permit the tray to be moved to its inoperative position in response to such an error signal.

One object of my invention is to provide an under the counter cash dispenser of the type which delivers money to an open delivery tray.

Another object of my invention is to provide a currency dispenser which does away with the requirement that the operator manually remove bills from the delivery tray in the event of a malfunction.

Still another object of my invention is to provide a currency dispenser having a delivery tray which is normally locked against movement to its inoperative position by a mechanical lock which is readily releasable upon the occurrence of an error signal.

A still further object of my invention is to provide a currency dispenser which is simple in construction and certain in operation.

Other and further objects of my invention will appear from the following description.

BRIEF DESCRIPTION OF THE DRAWINGS

In the accompanying drawings to which reference is made in the instant specification and which are to be read in conjunction therewith and in which like reference characters are used to indicate like parts in the various views:

FIG. 5 is a fragmentary view illustrating the drive system of the elevating and delivery system of FIG. 3 and 4.

FIG. 8 is a side elevation of an alternate form of delivery tray locking and operating mechanism which I may employ in my currency dispenser.

DESCRIPTION OF THE PREFERRED EMBODIMENT

Figure 1:
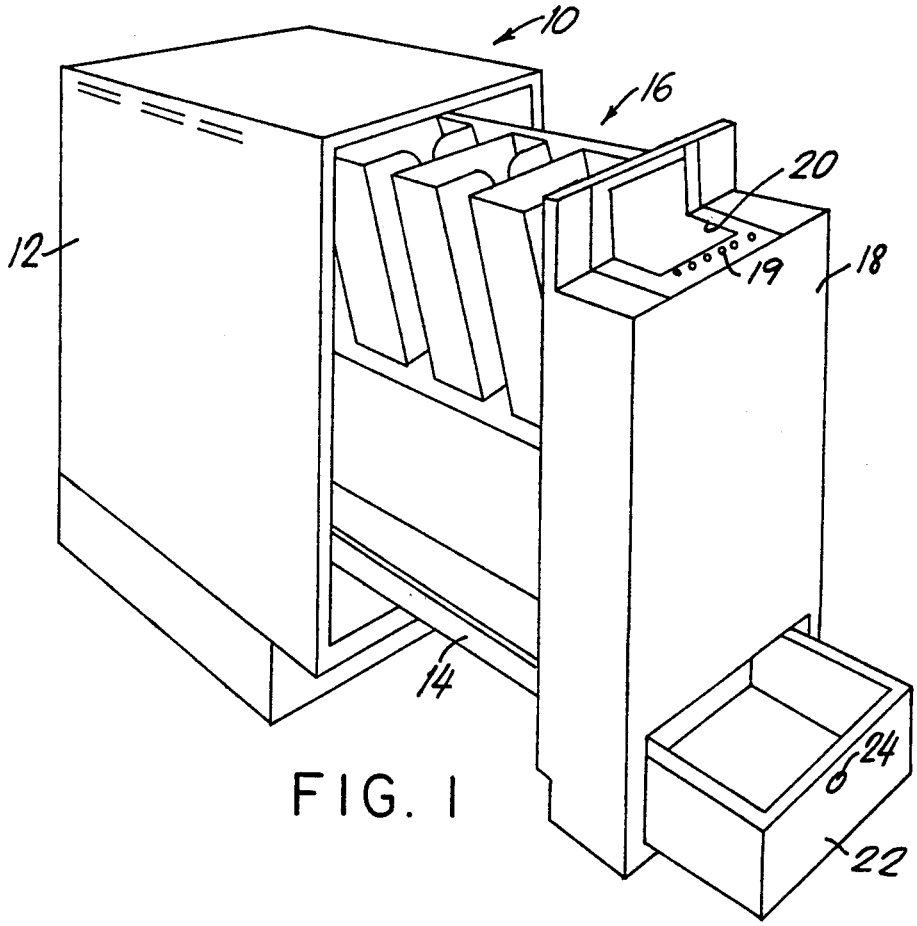
FIG. 1 is a perspective view of my under the counter currency dispenser.
Figure 2:
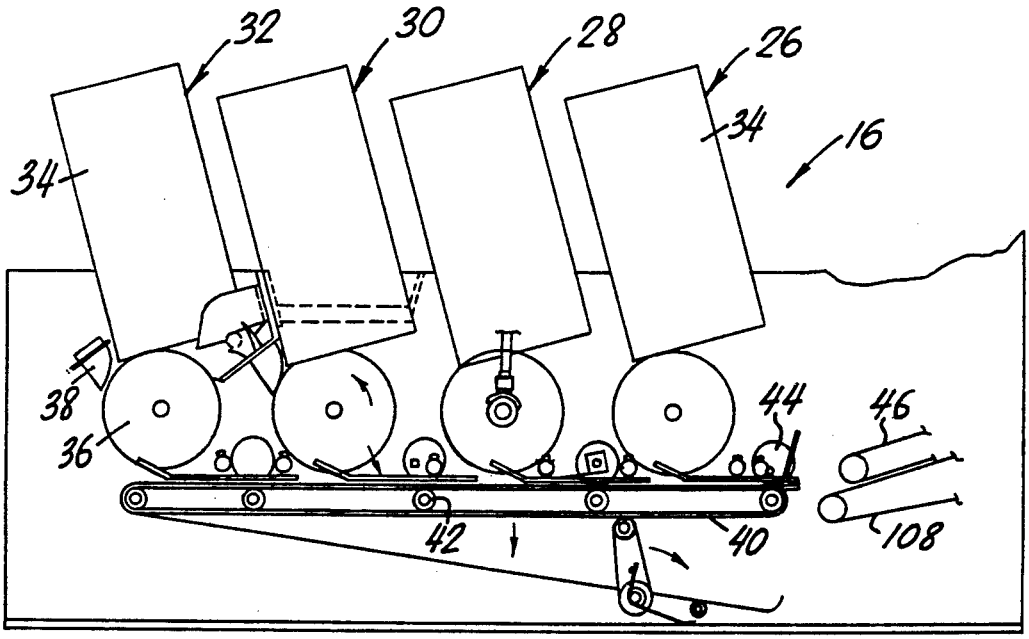
FIG. 2 is a fragmentary view of a portion of the currency dispenser illustrated in FIG. 1.

Referring now to FIGS. 1 and 2, my under the counter currency dispenser indicated generally by the reference character 10, includes a cabinet 12 which supports a slide 14 carrying the dispensing mechanism indicated generally by the reference character 16.

As will be explained more fully hereinbelow, the mechanism 16 delivers bills from various supplies to an elevator arrangement within a front housing 18 which moves with the slide. These bills are carried upwardly to a delivery tray located within an access opening 20 at the top of the housing 18. A plurality of pushbuttons 19 in front of the opening 20 control the operation of the dispenser.

Further, as will be described hereinbelow, in the event of a malfunction bills which have already been positioned on the delivery tray are dumped into an escrow drawer 22 at the bottom of the housing 18. A key operated lock 24 normally locks the drawer 22 in its closed position at which it can receive bills dumped in response to an error signal.

Referring now to FIG. 2, the dispensing apparatus 16 includes four currency units indicated generally by the respective reference characters 26, 28, 30 and 32, which may, for example, carry four different denominations of bills. Each of the units includes a supply housing 34, a feed roll 36, and a stripper 38 associated with the feed roll 36. As is described more fully in the '822 patent referred to hereinabove, each of the units is adapted to be actuated to withdraw the lowermost bill from a stack of bills in its supply housing 34 and to deliver it to a conveyor belt 40 extending generally horizontally across the space below the units. Each stripper 38 ensures that only one bill at a time is withdrawn from its supply and fed to the belt 40. Belt supporting rollers cooperate with pinch rollers 44 to carry all of the bills deposited on the conveyor from left to right as viewed in FIG. 2.

Figure 3:
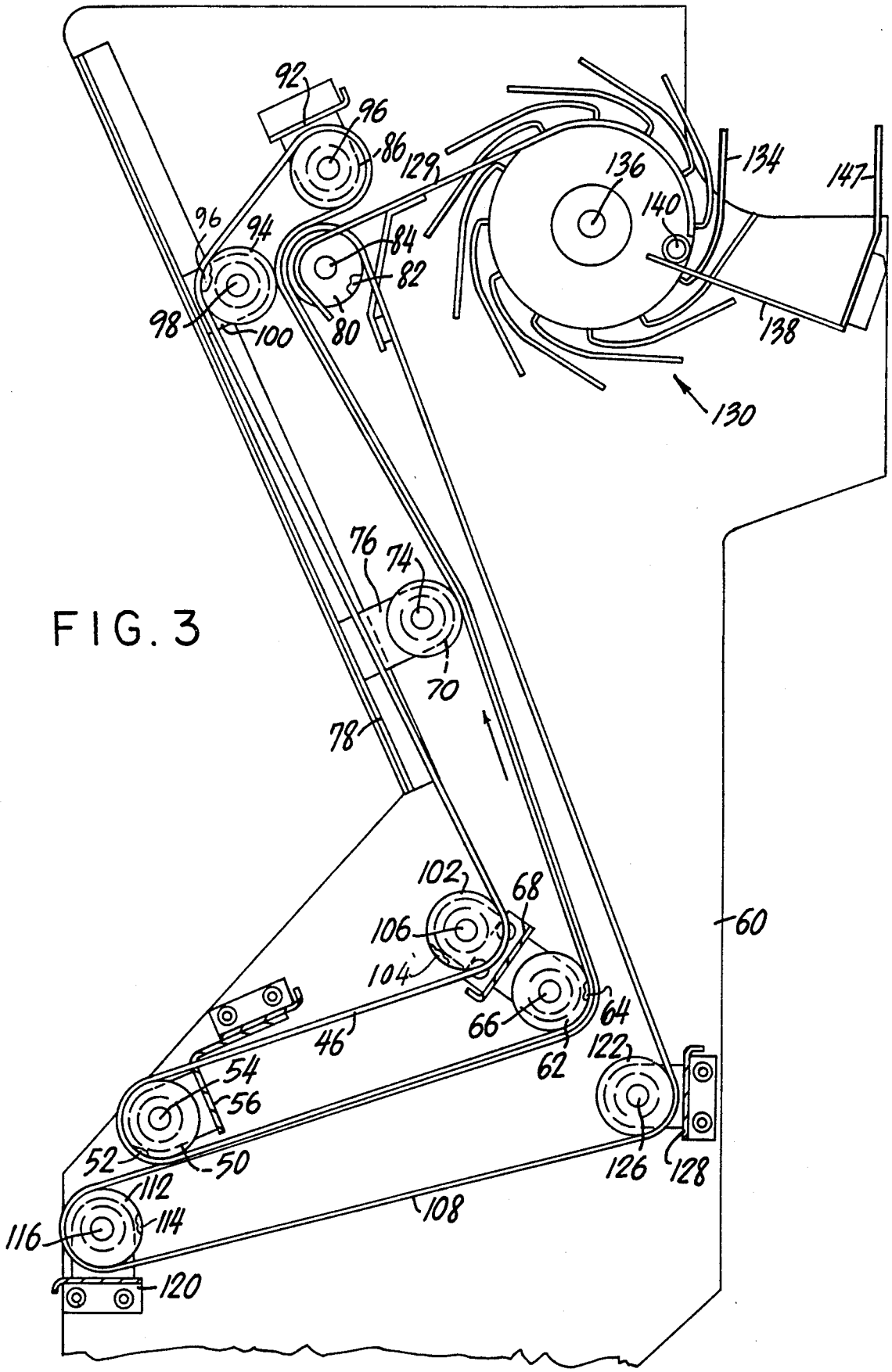
FIG. 3 is a side elevation of the vertical conveyor and delivery system of the currency dispenser illustrated in FIG. 1.
Figure 4:
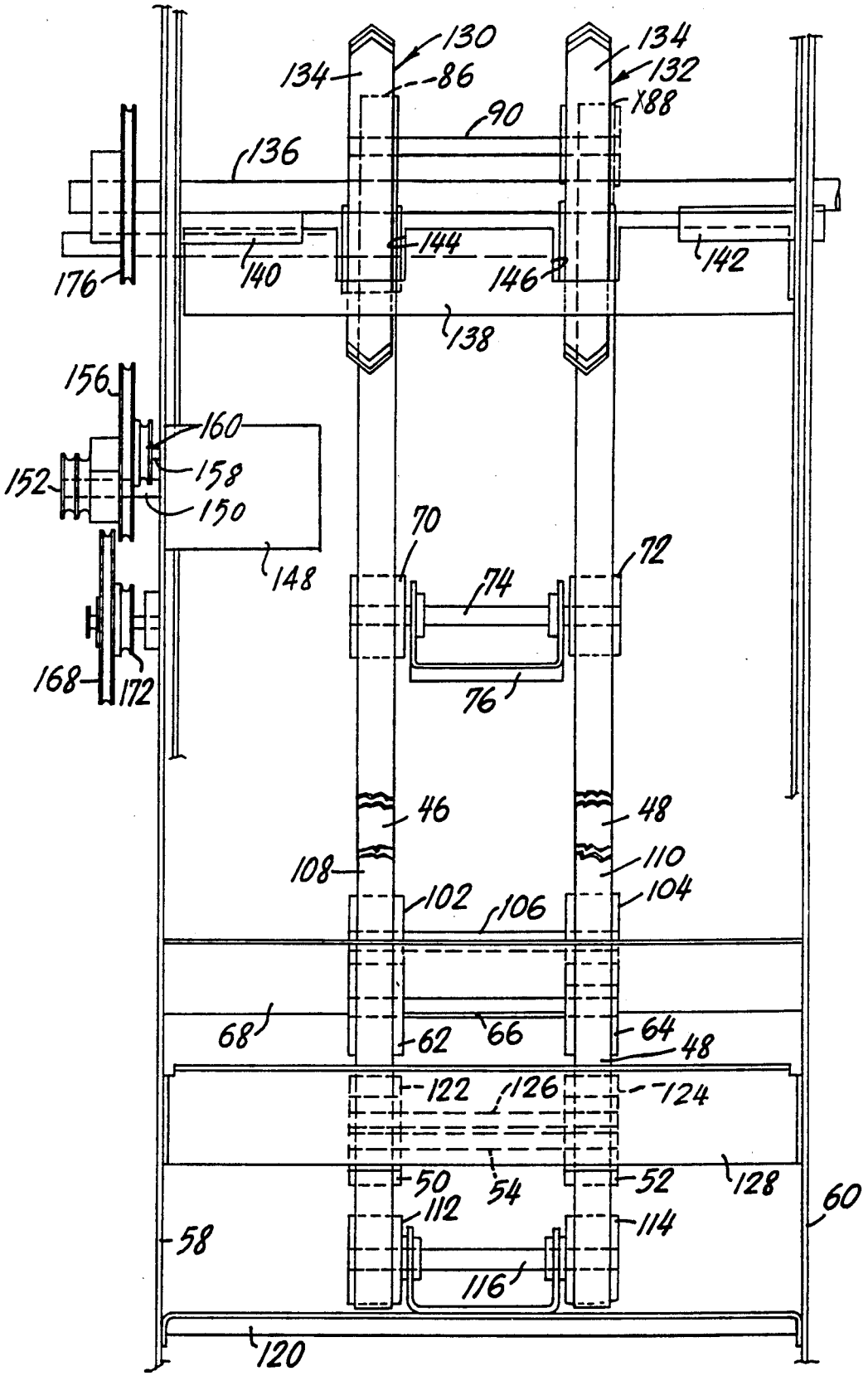
FIG. 4 is a front elevation of the elevator and delivery system illustrated in FIG. 3.

Referring now to FIGS. 2 to 4, the note elevating and delivery system disposed within the front housing 18 includes a pair of spaced outer elevator system belts 46 and 48 extending generally forwardly and slightly upwardly from a pair of lower entry support rollers 50 and 52 carried by a shaft 54 on a bracket 56 secured between the sides 58 and 60 of the elevator and delivery unit.

From the rollers 50 and 52, lower stands of the belts 46 and 48 extend to respective turn rollers 62 and 4 supported on a shaft 66 carried by a bracket 68 secured between the sides 58 and 60. Rollers 62 and 64 direct the belts 46 and 48 generally upwardly and slightly rearwardly past belt tensioning rolls 70 and 72 supported on a shaft 74 carried by a bracket 76 secured to a plate 78 carried between the sides 58 and 60.

From the tensioning rollers 70 and 72, the belts 46 and 48 pass inner belt return rollers 80 and 82 supported on a shaft 84 and extend upwardly and around respective outer belt return rollers 86 and 88 carried by a shaft 90 on a bracket 92 extending between the sides 58 and 60.

Belts 46 and 48 extend from return rollers 86 and 88 to respective guide rollers 94 and 96 carried by a shaft 98 on a bracket 100. Guide rollers 94 and 96 direct the belt 46 and 48 generally downwardly and slightly forwardly to respective turn rollers 102 and 104 carried by a shaft 106 supported on the bracket 68. Rollers 102 and 104 direct the belts 46 and 48 back to the lower entry rollers 50 and 52.

The conveyor and delivery system includes a pair of inner belts 108 and 110 associated respectively with the outer belts 46 and 48. Lower stands of the belts 108 and 110 extend generally forwardly and slightly upwardly from a pair of entry rollers 112 and 114 carried by a shaft 6 on a bracket 120 extending between sides 58 and 60 to a pair of guide rollers 122 and 124 on a shaft 126 carried by a bracket 128 adjustably secured to the sides 58 and 60.

From the guide rollers 122 and 124, belts 108 and 110 extend generally upwardly and slightly rearwardly to and around rollers 80 and 82 which direct the belts downwardly past the tensioning rollers 70 and 72 which direct the belts downardly to rollers 62 and 64 which guide the belts back to the entry rollers 112 and 114.

From the structure just described, it will be seen that the lower extents of belts 46 and 48 and the upper extents of belts 108 and 110 between the sets of rollers 50 and 52 and 62 and 64, together with the right-hand extents of belts 46 and 48 and the left-hand extents of belts 108 and 110 between pairs of rollers 62 and 64 and 80 and 82, all as viewed in FIG. 3, form a conveyor for receiving notes discharged by the conveyor belt 40 and for feeding such notes first generally forwardly and then upwardly to a discharge point at which belts 108 and 110 separate from belts 46 and 48 in the space between the sets of rollers 80 and 82 and 86 and 88.

Notes discharged from between the pairs of belts 46 and 48 and 108 and 110 at the upper end of the conveyor and delivery mechanism are directed by a guide 129 to a pair of stacker wheels 130 and 132 carried by a shaft 136 extending between the sides 58 and 60. As is known in the art, each of the stacker wheels 130 and 132 includes a plurality of fingers 134, adjacent ones of which form pockets for receiving individual notes. As will be described more fully hereinbelow, the stacker wheels 130 and 132 are driven to carry notes received between adjacent fingers 134 to a delivery tray 138 on which the notes are stacked. Delivery tray 138 is pivotally supported on the sides 58 and 60 by respective stub shafts 140 and 142. Cutout slots 144 and 146 in the tray 138 inboard of the stub shafts accommodate the fingers 134 of the respective stacker wheels 130 and 132. We provide the apparatus with a baffle or wall 147 extending between the sides 58 and 60 against which the outer edges of the notes in the stack on tray 138 rest.

The elevating and delivery system of my under the counter cash dispenser includes a drive system which, although independent of the drive system of the assembly 16 is such that the conveyor system including belts 46 and 48 and 108 and 110 is driven at a speed which is faster than that of the belt 40. Referring now to FIG. 5, the drive of my bill elevating and delivery system includes a motor 148 mounted on the side 58. Motor 148 has a shaft 150 carrying a double pulley 152 which receives a first belt 154 for driving a pulley 156 on a shaft 158 supported in side 58. Owing to the fact that pulley 156 is of a larger diameter than is pulley 152, the rotational speed of shaft 158 is less than that of the shaft 150 by a predetermined amount. Shaft 158 carries a second pulley 160 connected by a belt 162 to a pulley 164 on shaft 84 so as positively to drive the belts 108 and 110 in the direction of the arrow shown adjacent to belt 108 in FIG. 3.

The double pulley 152 receives a second belt 166 which engages a pulley 168 on a shaft 170 supported in the side 58. Pulley 168 is of a larger diameter than is the pulley 152 so as to provide a first speed stepdown from shaft 150 to shaft 170. Shaft 170 carries a second pulley 172 connected by a belt 174 to a pulley 176 on shaft 136. Pulley 176 is of a relatively larger diameter than is the pulley 172 so as to provide a further speed stepdown from shaft 170 to shaft 136. In this way I ensure that the stacker wheels 130 and 132 are driven at a slower speed than is the belt system. It will be noted that, in FIG. 4 the various pulleys have been shown laterally displaced from their actual positions.

From the structure thus far described, it will be clear that in operation of my under the counter cash dispenser bills making up the amounts to be dispensed will be withdrawn from the supply containers 34 of the various units 26, 28, 30 and 32 and delivered to the conveyor 40. This conveyor, in turn, delivers the bills to the conveyor made up by the cooperating lengths of the pairs of belts 46 and 48 and 108 and 110 which carry the bills upwardly and forward them to the stacker wheels 130 and 132 which form a stack of the bills on the delivery tray 138.

I provide my machine with means for normally locking the tray 138 in the position at which it receives bills while at the same time permitting it to be moved in response to an error signal to a broken line position shown in FIG. 3 at which bills thereon drop down into the escrow drawer 22.

Figure 7:
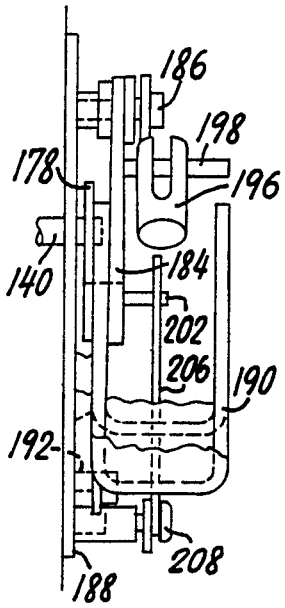
FIG. 7 is an end elevation of the mechanism shown in FIG. 6.
Figure 6:
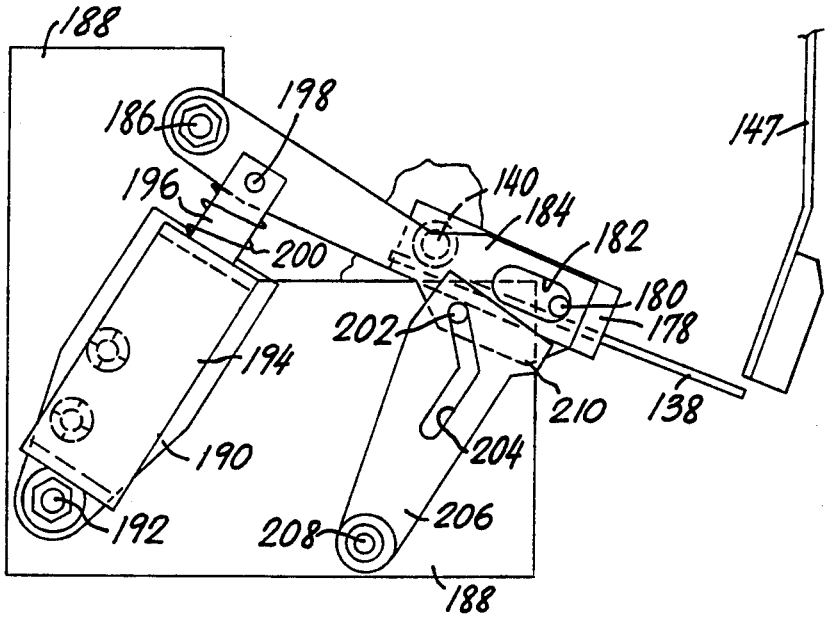
FIG. 6 is a side elevation of one form of delivery tray locking and operating mechanism which I may employ in my dispenser.

Referring now to FIGS. 6 and 7, I mount a crank arm 178 on stub shaft 140 for rotation therewith. This arm 178 carries a pin 180 disposed in a slot 182 formed in an operating arm 184 supported on a pivot 186 carried by a plate 188 attached to the outside of side 60. A bracket 190 swingably supported on a pivot pin 192 on the plate 188 supports a solenoid 194 having an armature 196 connected by a pin 198 to the operating arm 184 at a location intermediate the ends thereof. A spring 200 normally biases the armature outwardly to hold the arm 184 in a position at which the tray 138 is in its operative position.

A pin 202 on the arm 184 adjacent to the outer end thereof, rides in a slot 204 formed in a control arm 206 pivotally supported by a pin 208 on the plate 188. I form the control arm 206 with a nose 210 disposed in the path of movement of pin 180 if an attempt is made to rotate the tray 138 in a clockwise direction in the absence of energization of solenoid 194. It will readily be appreciated that nose 210 forms a stop while pin 180 is a stop engaging element. Pin 202 and slot 204 form a first connection between the operating arm 184 and stop 210 on the control arm 206. Pin 180 on the tray 138 and slot 182 in the control arm 184 provide a second lost motion connection between the tray 138 and the arm 184.

Referring now to FIG. 8, I have shown a modified form of the delivery tray locking and operating mechanism in which I combine the functions of the operating and locking arms 184 and 206. In this form of my operating and locking mechanism, pin 198 connects the armature 196 to an arm 212 pivotally supported on a pin 214 on the plate 188. An opening 216 in the arm 212 receives a pin 218 on a crank 220 carried by shaft 140 for rotation therewith. Crank 220 carries a pin 222, movement of which is blocked by a nose portion 224 of the arm 212 in the event an attempt is made to move the shelf 138 to its inoperative position in the absence of any energization of the solenoid 194. It will be appreciated that the nose portion 224 forms a stop while pin 222 is a stop engaging element. Moreover, pin 218 and opening 216 provide a lost motion connection between the operating arm 212 and the tray 138.

Figure 9:
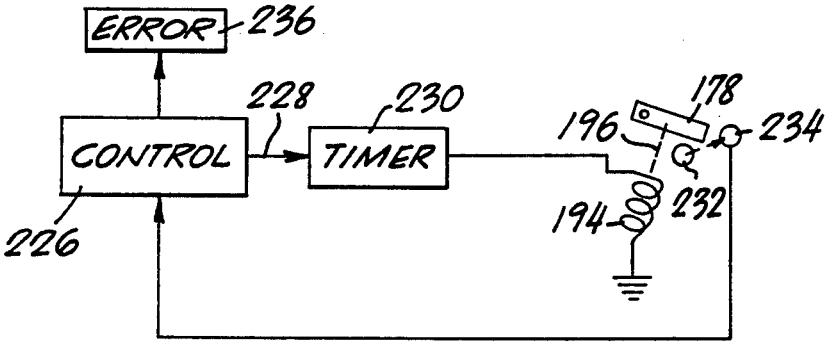
FIG. 9 is a schematic diagram of the control system for the tray locking and operating mechanism of my dispenser.

Referring now to FIG. 9, my dispenser includes a control system indicated by the block 226, the details of which are shown and described in the '914 patent. As is described therein, in response to certain malfunctions, the control system puts out a signal on a channel 228. I apply this signal to a timer 230 to energize the solenoid 194 to cause armature 196 to operate crank 178 to pivot the door 138 to the open position at which any notes thereon drop down into the escrow drawer 22. Timer 230 ensures that the tray 138 remains in its inoperative position for a length of time sufficient to permit all of the notes in the conveyor system to pass thereby before the tray is restored to its operative position.

In the course of moving the tray 138 to its inoperative position, arm 178 moves from a position out of the path of energy from a source 232 to a sensor 234 to a position in that path to block the energy. As a result, as is described in the '914 patent in connection with the output tray sensor shown therein, no further dispensing operation can be initiated until the path of energy is restored. After the path has been restored and detector 234 receives energy from source 232, control 226 initiates a second dispensing operation. If the third dispensing operation still results in an error signal, the control system stops the apparatus entirely and an error indication is given on a suitable display 236.

In operation of my cash dispenser, the amount to be dispensed is fed into the apparatus from any suitable source, such for example as the keyboard 19. In response thereto, and in the manner pointed out in the '822 and '914 patents, the apparatus 16 delivers bills from the supply containers 34 of the various units 26, 28, 30 and 32, as necessary to make up the amount to be dispensed. These bills are fed to the conveyor system 40 which delivers the bills to the pairs of belts 48 and 50 and 108 and 110. These pairs of belts which are driven at a relatively faster rate than the belt system 40, carry the bills upwardly to the stacker wheels 130 and 132 which deliver them to the output tray 138. If the amount is correct, the teller or other operator removes the stack of bills and hands them to the customer.

In the event any one of a number of malfunctions occurs, the operation of removing bills from the respective stacks stops. Belt system 40, however, continues to move to deliver any bills which have already been withdrawn to the pairs of belts 48 and 50 and 108 and 110.

In response to the error signal, the solenoid 194 is energized to rotate the operating arm 184 in a clockwise direction as viewed in FIG. 6. In response to the intitial movement of this arm, the pin 202 riding in the slot 204 rotates the control arm 208 in a counterclockwise direction to move the nose 210 out of the path of movement of pin 180. Upon continued movement of the arm 184, the slot 182 engages pin 180 to move crank 178 and the tray 138 in a clockwise direction to a position at which bills thereon drop downwardly to the escrow drawer 22. Timer 230 ensures that the solenoid 194 remains energized for a sufficient period of time that all of the bills in the conveyor system have moved past the tray 138.

In the course of its movement from operative to inoperative position, the crank 178 interrupts the path of energy between the source 232 and the sensor 234. This conditions the control system 226 to prevent any further dispensing operation.

After the last bill from the conveyor system has passed the shelf 138, timer 230 permits the shelf and the crank 178 to be restored to their operative positions under the action of spring 200. When the path of energy from source 232 to sensor 234 is thus restored, the control system 226 permits another dispensing attempt to be made. If this and another operation result in an error, no further attempts are made and an error signal is given to the operator.

The operation of the mechanism shown in FIG. 8 is substantially the same as that of FIGS. 6 and 7. When solenoid 194 is energized, it moves control arm 212 to the broken line position at which the nose 224 is out of the path of movement of pin 222 before the hole 216 engages the pin 218 to rotate crank 220 in a clockwise direction.

Both the mechanism shown in FIGS. 6 and 7 and that in FIG. 8 prevent the shelf 138 from being moved manually to its inoperative position in the absence of energization of the solenoid 194. It will be seen that if an attempt is made to move shelf 138 manually in a clockwise direction in an effort to obtain access to the escrow drawer 22, pin 180 will engage nose 210 before any appreciable movement of the tray has taken place. Similarly, the pin 222 will engage nose 224 before any appreciable movement of shelf 138 has taken place in the form of the device illustrated in FIG. 8.

It will be seen that I have accomplished the objects of my invention. I have provided an under the counter cash dispenser of the type which delivers money to an open delivery tray. My dispenser does away with the need for manual removal of bills from the delivery tray in the event of a malfunction. It simplifies accounting for supplies of money which have been placed in the dispenser. It is simple in construction and operation for the result achieved thereby.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for dispensing currency notes including in combination a cabinet having a front provided with an opening forming a delivery location which is freely accessible to a user, means fin said cabinet for holding a supply notes, normally enabled conveying means extending from said supply means to said delivery location, normally enabled means for removing notes from said supply and delivering removed notes to said conveying means, a tray, means mounting said tray at said delivery location for movement between an operative position at which it receives notes from said conveying means and an inoperative position at which notes conveyed to said delivery location pass by said tray to an escrow area in said cabinet, means normally holding said tray in its operative position, means responsive to a malfunction of said removing and delivering means for producing an error signal, first means responsive to said error signal for immediately disabling said removing and delivering means while said conveying means remains enabled, and second means responsive to said error signal for immediately moving said tray to its operative position and including a timer for maintaining said tray in its inoperative position until all notes received by said conveying means have been carried to said delivery location.

2. Apparatus as in claim 1 including means normally locking said tray in said operative position, said second means responsive to said error signal sequentially releasing said locking means and moving said tray to said inoperative position.

3. Apparatus as in claim 2 in which said second means responsive to said error signal comprises energizable means for sequentially releasing said locking means and moving said tray to said inoperative position.

4. Apparatus as in claim 3 in which said locking means comprises interengageable means adapted to engage upon movement of said tray in the absence of energization of said energizable means.

5. Apparatus as in claim 3 in which said locking means comprises an element carried by said tray for movement therewith, and a stop in the path of said element upon movement of said tray in the absence of energization of said energizable means.

6. Apparatus as in claim 3 including means responsive to movement of said tray to its inoperative position for preventing re-enablement of said removing and delivering means while said tray remains in its inoperative position.

7. Apparatus as in claim 1 in which said delivery location is above said note removing means, said conveying means comprising a first conveyor for receiving notes from said removing means, a second conveyor for receiving notes from said first conveyor and for carrying notes to said access location and means for driving said second conveyor faster than said said first conveyor.

8. Apparatus as in claim 7 including a stacker wheel at said access location for receiving notes from said second conveyor and delivering notes to said tray and means for driving said stacker wheel at a speed lower than said second conveyor.

9. In a currency note dispenser, apparatus including a delivery tray, means mounting said tray for pivotal movement between an operative position at which notes delivered thereto are received by said tray and an inoperative position at which notes delivered thereto pass by said tray, a stop engaging element carried by said tray, a stop, means mounting said stop for movement between an operative position in the path of said element upon movement of said tray toward its inoperative position and an inoperative position out of the path of said element upon said movement of said tray, an operating arm, means mounting said operating arm for movement between a normal position and an actuated position, a first connection between said operating arm and said stop, a second lost-motion connection between said operating arm and said tray, means for holding said arm in said normal position to hold said tray and said stop in said operative positions and error-responsive means for moving said operating arm to its actuated position whereby said first and second connections sequentially move said stop and said tray to their inoperative positions.

10. Apparatus as in claim 9 in which said lostmotion connection is a pin-and-slot connection, said pin being said stop engaging element.

11. In a currency note dispenser, apparatus including a delivery tray, means mounting said tray for pivotal movement between an operative position at which notes delivered thereto are received by said tray and an inoperative position at which notes delivered thereto pass by said tray, a stop engaging element carried by said tray, an operating arm formed with a stop, means mounting said operating arm for movement between a normal position at which said stop is in the path of said element upon movement of said tray toward its inoperative position and an actuated position at which said stop is out of the path of said element, a lost-motion connection between said tray and said operating arm, means for holding said arm in said normal position to hold said tray in its operative position, and error responsive means for moving said operating arm to its actuated position sequentially to move said stop out of the path of said element and then said tray to its inoperative position through said lost-motion connection.

12. Apparatus for dispensing currency notes including in combination a cabinet formed with an opening at a delivery location which is freely accessible to a user, means in said cabinet for holding a supply of notes, means for removing notes from said supply, means for conveying removed notes to said delivery location, a delivery tray, means mounting said tray in said cabinet adjacent to said opening for movement between an operative position at which it receives notes conveyed to said delivery location and an inoperative position at which notes conveyed to said delivery location pass by said tray to an escrow area in said cabinet, means normally holding said tray in its operative position, and means responsive to a malfunction of said withdrawing means in the course of a dispensing operation of said apparatus for immediately moving said tray to said inoperative position whereby all notes which have been conveyed to said delivery location in the course of said dispensing operation pass to said escrow area, a stop-engaging element carried by said tray, a stop, means mounting said stop for movement between an operative position in the path of said element upon movement of said tray toward its inoperative position and an inoperative position out of the path of said element upon said movement of said tray, said means normally holding said tray in its operative position comprising an operating arm, means mounting said operating arm for movement between a normal position and an actuated position, a first connection between said operating arm and said stop, a second lost-motion connection between said operating arm and said tray and means for holding said arm in said normal position to hold said tray and said stop pin said operative positions, said malfunction-responsive means comprising means for moving said operating arm to its actuated position whereby the first and second connections sequentially move said stop and said tray to inoperative positions.

13. Apparatus for dispensing currency notes including in combination a cabinet formed with an opening at a delivery location which is freely accessible to a user, means in said cabinet for holding a supply of notes, means for removing notes from said supply, means for conveying removed notes to said delivery location, a delivery tray, means mounting said tray in said cabinet adjacent to said opening for movement between an operative position at which it receives notes conveyed to said delivery location and an inoperative position at which notes conveyed to said delivery location pass by said tray to an escrow area in said cabinet, means normally holding said tray in its operative position, and means responsive to a malfunction of said withdrawing means in the course of a dispensing operation of said apparatus for immediately moving said tray to said inoperative position whereby all notes which have been conveyed to said delivery location in the course of said dispensing operation pass to said escrow area, a stop-engaging element carried by said tray, said means for holding said tray in its operative position comprising an operating arm formed with a stop, means mounting said operating arm for movement between an normal position at which said stop is in the path of said element upon movement of said tray towards its inoperative position and an actuated position at which said stop is out of the path of said element, a lost-motion connection between said tray and said operating arm, and means for holding said arm in said normal position to hold said tray in its operative position, and in which said malfunction responsive means comprises means for moving said operating arm to its actuated position sequentially to move said stop out of the path of said element and then to move said tray to its inoperative position through said lost-motion connection.

14. Apparatus as in claim 13 in which said operating arm moving means comprises a solenoid, means responsive to an error signal for energizing said solenoid and means for maintaining the energization of said solenoid for a predetermined time after the initial energization thereof.

15. Apparatus as in claim 14 including means responsive to movement of said tray to its inoperative position for preventing re-enablement of said removing and delivering means while said tray remains in its inoperative position.

* * * * *

UNITED STATES PATENT AND TRADEMARK OFFICE

CERTIFICATE OF CORRECTION

PATENT NO. : 5,062,598

DATED : November 5, 1991

INVENTOR(S) : Theodore Winkler

It is certified that error appears in the above-identified patent and that said Letters Patent is hereby corrected as shown below:

Claim 1, col. 7, line 16, change "fin" to --in--;

Claim 1, col. 7, line 16, change "supply notes" to --supply of notes--;

Claim 1, col. 7, line 38, change "operative" to --inoperative--;

Claim 8, col. 8, line 9, change "lower" to --slower--;

Claim 12, col. 9, line 19, change "pin" to --in--.

Signed and Sealed this

Second Day of March, 1993

*Attest:*

STEPHEN G. KUNIN

*Attesting Officer*

*Acting Commissioner of Patents and Trademarks*